US005420667A

United States Patent [19]

Kaneko et al.

[11] Patent Number: 5,420,667

[45] Date of Patent: May 30, 1995

[54] COMMUNICATION CONTROL APPARATUS FOR MONITORING A CONDITION OF AN IMAGE FORMING APPARATUS AND INHIBITING TRANSMISSION OF DATA WHEN A POWER SUPPLY MEANS IS TURNED OFF

[75] Inventors: Satoshi Kaneko, Kawasaki; Masanori Miyata, Yokohama; Hideki Adachi; Shinichi Nakamura, both of Kawasaki; Naoyuki Ohki; Tokuharu Kaneko, both of Yokohama; Satoshi Kuroyanagi; Hiroshi Ozaki, both of Tokyo; Hisatsugu Tahara, Kawasaki; Taisei Fukada; Mitsuharu Takizawa, both of Tokyo, all of Japan

[73] Assignee: Canon Kabushiki Kaisha, Tokyo, Japan

[21] Appl. No.: 168,133

[22] Filed: Dec. 17, 1993

Related U.S. Application Data

[63] Continuation of Ser. No. 868,865, Apr. 16, 1992, Pat. No. 5,293,196.

[30] Foreign Application Priority Data

| | | | |
|---|---|---|---|
| Apr. 18, 1991 | [JP] | Japan | 3-085606 |
| Apr. 18, 1991 | [JP] | Japan | 3-085607 |
| Apr. 18, 1991 | [JP] | Japan | 3-085608 |
| Apr. 18, 1991 | [JP] | Japan | 3-085624 |

[51] Int. Cl.[6] ..... G03G 15/00

[52] U.S. Cl. ..... 355/206; 395/113

[58] Field of Search ..... 355/200, 202, 204; 340/679; 364/138; 371/16.4, 66; 379/100, 106; 395/113

[56] References Cited

U.S. PATENT DOCUMENTS

| | | | |
|---|---|---|---|
| 3,305,839 | 2/1967 | Looschen et al. | 340/172.5 |
| 3,623,013 | 11/1991 | Perkins et al. | 340/172.5 |
| 3,638,191 | 1/1972 | Mann | 340/163 |
| 3,656,145 | 4/1972 | Proops | 340/310 |
| 3,735,043 | 5/1973 | Riethmeier et al. | 178/69 G |
| 3,842,408 | 10/1974 | Wells | 340/216 |

(List continued on next page.)

FOREIGN PATENT DOCUMENTS

| | | |
|---|---|---|
| 0121332 | 10/1984 | European Pat. Off. . |
| 0342910 | 11/1989 | European Pat. Off. . |
| 56-27161 | 3/1981 | Japan . |
| 59-22475 | 2/1984 | Japan . |
| 59-81656 | 5/1984 | Japan . |
| 59-89067 | 5/1984 | Japan . |
| 59-91456 | 5/1984 | Japan . |
| 59-116761 | 11/1984 | Japan . |
| 60-101664 | 6/1985 | Japan . |
| 60-230167 | 11/1985 | Japan . |
| 62-84653 | 4/1987 | Japan . |
| 63-122349 | 5/1988 | Japan . |
| 2066737 | 7/1981 | United Kingdom . |
| 9203789 | 3/1992 | WIPO . |

OTHER PUBLICATIONS

Lavery, "Servi Bridge Amplifier," Xerox Disclosure Journal, vol. 13, No. 4, p. 215, Jul./Aug. 1988.

Patent Abstracts of Japan, vol. 10, No. 323 (M-531), with respect to Japanese Patent Document No. 61-130174 (Jun. 18, 1986).

Hyde, et al., "Copier Power Control System," IBM Technical Disclosure Bulletin, vol. 25, No. 2, Jul. 1982.

Xerox 1090 Copier Electronic Data Interface Operator Guide (no date).

Kodak Ektraprint (Telassistance Network) Brochure, Copyright, Eastman Kodak Company, 1986.

*Primary Examiner*—Joan H. Pendegrass

*Attorney, Agent, or Firm*—Fitzpatrick, Cella, Harper & Scinto

[57] ABSTRACT

A machine monitoring apparatus includes an input device for receiving data from a machine, the data being indicative of a condition of the machine, a storage device for storing the received data, a communication device for communicating between the storage device and an external apparatus installed at a position separate from the machine, and a control device for inhibiting the communication device from transmitting the data stored in the storage device when a power supply for supplying the machine with electric power is turned off while the data is being received by the input device.

8 Claims, 12 Drawing Sheets

U.S. PATENT DOCUMENTS 3,858,181 12/1974 Goldsby et al. ..... 340/150
3,916,177 10/1975 Greenwald ..... 235/153
3,984,032 10/1976 Hyde et al. ..... 222/26
3,997,873 12/1976 Thornton ..... 340/149 R
4,071,911 1/1978 Mazur ..... 364/900
4,124,887 11/1978 Johnson et al. ..... 364/107
4,144,550 3/1979 Donohue et al. ..... 364/107
4,167,322 9/1979 Yano et al. ..... 355/3 R
4,188,668 2/1980 Finlay ..... 364/900
4,199,100 4/1980 Wostl et al. ..... 235/381
4,283,709 8/1981 Lucero et al. ..... 340/147 R
4,290,138 9/1981 Bare et al. ..... 371/29
4,300,040 11/1981 Gould et al. ..... 235/381
4,311,986 1/1982 Yee ..... 340/825.63
4,312,066 1/1982 Bantz et al. ..... 371/16
4,314,334 2/1982 Daughton et al. ..... 364/200
4,358,756 11/1982 Morel et al. ..... 340/539
4,369,442 1/1983 Werth et al. ..... 340/825.35
4,399,538 8/1983 Cholakian et al. ..... 371/66
4,432,090 2/1984 da Silva ..... 371/32
4,455,453 6/1984 Parasekvakos et al. ..... 179/2
4,456,790 6/1984 Soyack ..... 179/18 ES
4,477,901 10/1984 Braband et al. ..... 371/15
4,496,237 1/1985 Schron ..... 355/14 C
4,497,037 1/1985 Kato et al. ..... 364/900
4,501,485 2/1985 Tsudaka ..... 355/6
4,506,974 3/1985 Sugiura et al. ..... 355/14 R
4,509,851 4/1985 Ippolito et al. ..... 355/14 C
4,510,491 4/1985 Prato ..... 340/792
4,519,088 5/1985 Rademacher et al. ..... 377/16
4,523,299 6/1985 Donohue et al. ..... 364/900
4,545,013 10/1985 Lyon et al. ..... 364/200
4,549,044 10/1985 Durham ..... 179/5 R
4,569,585 2/1986 Masuda ..... 355/14 R
4,574,283 3/1986 Arakawa et al. ..... 340/825.08
4,578,538 3/1986 Pascucci et al. ..... 179/2 DP
4,583,834 4/1986 Seko et al. ..... 355/14 C
4,593,323 6/1986 Kanda et al. ..... 358/256
4,595,921 6/1986 Wang et al. ..... 340/825
4,611,205 9/1986 Eglise ..... 340/825
4,630,042 12/1986 Kawasaki et al. ..... 340/825
4,633,412 12/1986 Ebert, Jr. et al. ..... 364/493
4,634,258 1/1987 Tanaka et al. ..... 355/4
4,639,889 1/1987 Matsumoto et al. ..... 364/900
4,652,698 3/1987 Hale et al. ..... 380/24
4,654,800 3/1987 Hayashi et al. ..... 364/479
4,658,243 4/1987 Kimura et al. ..... 340/505
4,708,469 11/1987 Bober et al. ..... 355/77
4,709,149 11/1987 Takahashi et al. ..... 250/317
4,712,213 12/1987 Warwick et al. ..... 371/15
4,723,212 2/1988 Mindrum et al. ..... 364/401
4,742,483 5/1988 Morrell ..... 364/900
4,745,602 5/1988 Morrell ..... 371/20
4,752,950 7/1988 Le Carpentier ..... 379/106
4,760,330 7/1988 Lias, Jr. ..... 324/73 R
4,766,548 8/1988 Cedrone et al. ..... 364/479
4,823,343 4/1989 Takahashi ..... 371/16
4,845,483 7/1989 Negishi ..... 340/825
4,870,526 9/1989 Maruta et al. ..... 361/1
4,916,607 4/1990 Teraichi et al. ..... 364/200
4,947,397 8/1990 Sobel et al. ..... 371/16.4
4,962,368 10/1990 Dobrzanski et al. ..... 340/514
4,991,114 2/1991 Kawamura et al. ..... 364/519
5,077,582 12/1991 Kravette et al. ..... 355/206
5,084,875 1/1992 Weinberger et al. ..... 371/291

LTR
100
101
102
102a
102b
103
104
105
106
107
108
109
110
111
112
113
114
115
116
117
118
119
120
121
122
123
124
125
126
127
128
129
130
131
132
133
134
140
141
142
150
200
210
300
400

COMMUNICATION CONTROL APPARATUS FOR MONITORING A CONDITION OF AN IMAGE FORMING APPARATUS AND INHIBITING TRANSMISSION OF DATA WHEN A POWER SUPPLY MEANS IS TURNED OFF

This application is a continuation of application Ser. No. 07/868,865, filed Apr. 16, 1992, now U.S. Pat. No. 5,293,196.

BACKGROUND OF THE INVENTION

1. Field of the Invention

The present invention relates to a machine managing one or more apparatus for concentratively managing conditions of a machine.

2. Description of the Related Art

A demand for the addition of a variety of functions and upgrades to a copier has caused the structure and functions of the copier to become more complicated. Also, the number of copiers installed in a company is increasing, so that normal using conditions and function data of these copiers are collected and concentratively managed by a management section of the company or a technical expert in order to manage the use of the copiers as well as attend to maintenance, appropriate and rapid repair for a trouble, and so on.

To realize such management, a copier is known, as described in U.S. Pat. No. 5,084,875, which is provided with a communication control unit for communicating with an external apparatus via a communication network to permit periodical or arbitrary communications such as transmission and reception of data between the copier and the external apparatus installed in a management section.

A copier is generally equipped therein with a security device for automatically isolating an abnormal portion upon occurrence of an abnormality in a part or operation of the copier, for example, a temperature fuse, a thermostat or the like for a fixer of the copier, so as to isolate the circuit of concern when the temperature abnormally rises due to trouble in a part of the machine, the occurrence of a malfunction or the like, to prevent such trouble from developing into a serious accident.

However, such a security device itself has a problem in that aging changes and deteriorates its constituent parts, which may result in preventing the security device from normal operation, and accordingly causing a delay in shutting off a power supply upon detecting an abnormality of a copier, thereby making an accident more serious.

Further, in a structure in which a security device is released by manipulating a main switch, monitoring and countermeasures of an abnormality are delayed.

Particularly, with a complicated copier which is concentratively managed by an external apparatus, it cannot be expected in practice to appropriately and rapidly attend to machine trouble detected by a copy operator.

In addition, there may occur other inconveniences when communications with the outside are disabled due to an abnormality of a communication control section of a copier, a communication network, or an external apparatus connected thereto, or when an error is included in the communicated contents. When an abnormal condition occurs in a communication system, although it may readily be detected that a communication control unit in the copier is suffering from trouble, it takes a lot of time and procedures to confirm whether the trouble is caused by an abnormality of the copier, a network, or an external apparatus, whereby the copier remains in an inoperative condition for a long time.

When communications are performed with the outside, a power supply of a copier must be turned on. If the power supply is shut off during a data communication with an external apparatus, by reason of termination of a copy operation or the like, the data communication with the outside is interrupted in an incomplete condition with communicated data being damaged, which results in largely damaging the reliability of the copier.

There is also known a copier which is provided with a storage unit for storing a using condition, control data and the like, such that data can be transmitted to an external apparatus installed in a management section or the like on a periodical basis or by a request generated by the management section.

However, when a request for starting a copy operation is generated during a periodical data transmission, or a data transmission requested by the management section or the like, a control unit concurrently performs a control for transmitting stored data and a copy control, that is, the objects to be controlled are increased in number whereby the processing speed is decreased, and an external network is arbitrated for a long time, which results in impeding other communications as well as increasing a network rental fee.

SUMMARY OF THE INVENTION

It is an object of the present invention to provide a machine managing apparatus which is capable of solving the above-mentioned problems.

It is another object of the present invention to provide an improved machine managing apparatus.

It is a further object of the present invention to provide a copier which can be remotely monitored by an external apparatus and remotely started and stopped by the decision of the external apparatus.

It is a further object of the present invention to provide a copier which is capable of preventing data from being damaged by incomplete execution of a data communication with an external apparatus via a communication network when a communication request is generated while a power supply of a copy control unit is off.

To achieve this object of the present invention, an apparatus and method are provided for monitoring an image forming apparatus in which an input device receives data from the image forming apparatus, the data being indicative of a condition of the image forming apparatus. A storage unit stores the received data, and a communication unit communicates between the storage unit and an external apparatus installed at a position separate from the image forming apparatus. A control unit inhibits the communication unit from transmitting the data stored in the storage unit when a power supply for supplying the image forming apparatus with electric power is turned off while the data is being received by the input unit. The monitoring apparatus may also include a detecting means for detecting whether the image forming apparatus is being supplied with electric power. Further, the data may be data relating to an abnormality of the image forming apparatus.

Other objects and features of the present invention will become apparent from the following description when read with reference to the accompanying drawings.

DESCRIPTION OF THE PREFERRED EMBODIMENTS

Embodiments of the present invention will hereinafter be described with reference to the accompanying drawings.

Figure 1:
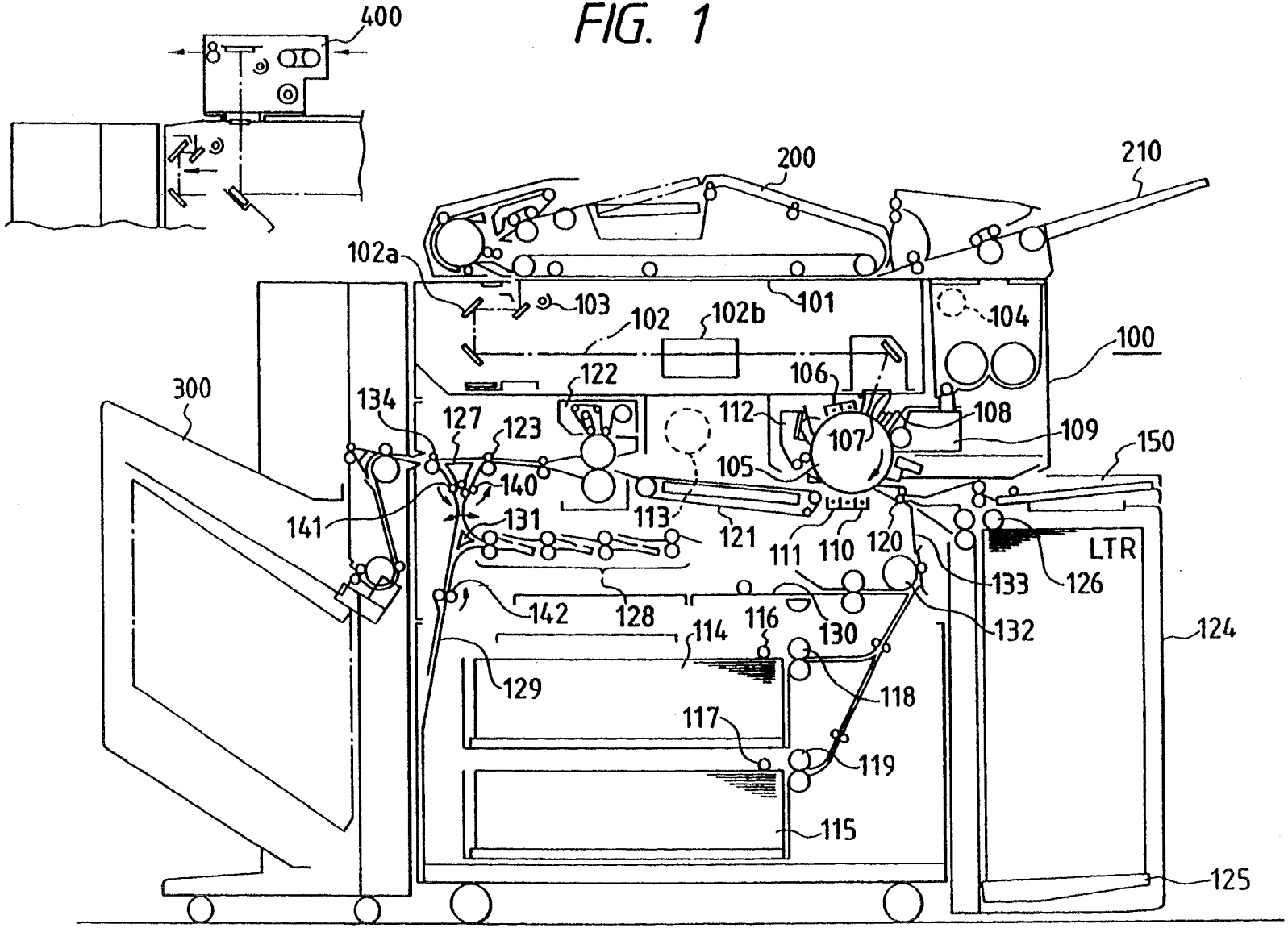
FIG. 1 is a cross-sectional view of a copier according to an embodiment of the present invention.

FIG. 1 is a cross-sectional view showing the structure of a copier 100 according to an embodiment of the present invention. The structure and operation of the copier 100 will be described with reference to FIG. 1.

Reference numeral 100 designates a copier body, 200 a circulation-type automatic document feeder (hereinafter called "RDF") for automatically feeding originals, 300 a sorter for sorting copied sheets, and 400 an automatic computer form feeder (hereinafter called "CFF"), where the RDF 200, the sorter 300 and the CFF 400 can be freely combined with the copier body 100.

The structure of the copier body 100 will next be described.

In FIG. 1, reference numeral 101 designates an original glass for carrying an original, and 102 an optical system for reading an original which is composed of an exposing lamp 103 for illuminating an original; a scanning mirror 102*a;* a lens 102*b;* and a motor 104. The scanning mirror 102*a,* the lens 102*b,* and the exposing lamp 103 are moved by the motor 104 while the exposing lamp 103 illuminates an original, and a light reflected by the original is lead to irradiate a photo sensitive member drum 105.

The photo sensitive member drum 105 is equipped therearound with a high voltage unit 106; a blank exposure unit 107; a voltage sensor 108; a developer 109; a copying charger 110; a separating charger 111; and a cleaner 112, where an image is recorded on a fed sheet by these constituents including the photo sensitive member drum 105.

The photo sensitive member drum 105 is rotated by a main motor 113 in the direction indicated by the arrow. It is corona charged by the high voltage unit 106, and when a light from the optical system 102 reflected from an original irradiates the drum 105, an electro-static latent image is formed. This electrostatic latent image is developed by the developer 109 to be visualized as a toner image.

A sheet of transfer paper from an upper cassette 114 or a lower cassette 115, separated by pickup rollers 116, 117 and sent into the body 100 by sheet feeding rollers 118, 119, is aligned in position by a resist roller 120 such that the top end of a toner image on the photo sensitive member drum 105 coincides with the top end of the sheet, and then fed toward the photo sensitive member drum 105, and the toner image on the photo sensitive member drum 105 is transferred onto the sheet of transfer paper. After this image transfer, the sheet is separated from the photo sensitive member drum 105 by the separating charger 111, lead by a carrying belt 121 to a fixer 122 to be pressurized and heated to fix the toner image on the sheet, and thereafter discharged to the outside of the copier body 100 by a discharging roller 123. A surface of the photo sensitive member roller 105 is cleaned by the cleaner 112.

The copier body 100 is equipped with a deck 124 which can contain, for example, 4000 sheets of transfer paper. A lifter 125 of the deck 124 rises in accordance with the amount of sheets of transfer paper such that the topmost sheet is usually in contact with the sheet feeding roller 126.

A sheet of transfer paper delivered to the outside by the discharging roller 123 is lead to either a dual-face recording side or a multiple recording side by a discharging flapper 127. The sheet discharged from the discharging roller 123 is reversed by a reversing path 129 and lead to a sheet re-feeding tray 130 by a downward carrying path 128.

Reference numeral 131 designates a multiple flapper for switching a path for either a dual-face recording mode or a multiple recording mode. By inclining the multiple flapper 131 toward the left, a sheet of transfer paper is not lead to the reversing path 129 but directly to the downward carrying path 128. Reference numeral 132 designates a sheet feeding roller for feeding a sheet of transfer paper toward the photo sensitive member drum 105 via a path 133. Reference numeral 134 designates a discharging roller which is arranged in the vicinity of the discharging flapper 127 for discharging to the outside a sheet of transfer paper switched to be delivered to the discharging side.

When the dual-face recording (dual-face copy) mode or the multiple recording (multiple copy) mode is to be performed, the sheet discharging flapper 127 is raised to store copied sheets in a reversed state into the sheet re-feeding tray 130 via the reversing path 129 and the downward carrying path 128. In this event, the multiple flapper 131 is inclined toward the right for the dual-face recording mode and toward the left for the multiple recording mode. Sheets of transfer paper stored in the sheet re-feeding tray 130 are lead one by one by the sheet feeding roller 132 to the resist roller 120 via the path 133 when a back face is to recorded in the next step of a multiple recording.

When a copied sheet of transfer paper is discharged from the copier body 100 in a reversed state, the sheet discharging flapper 127 is raised and the flapper 131 is inclined toward the right to carry the copied sheet toward the carrying path 129. After the rear end of the sheet has passed a first feeding roller 140, the sheet is carried toward a second feeding roller 141 by a reversely rotating roller 141 and discharged to the outside by the discharging roller 134.

Next, a manipulation panel will be described.

Figure 2:
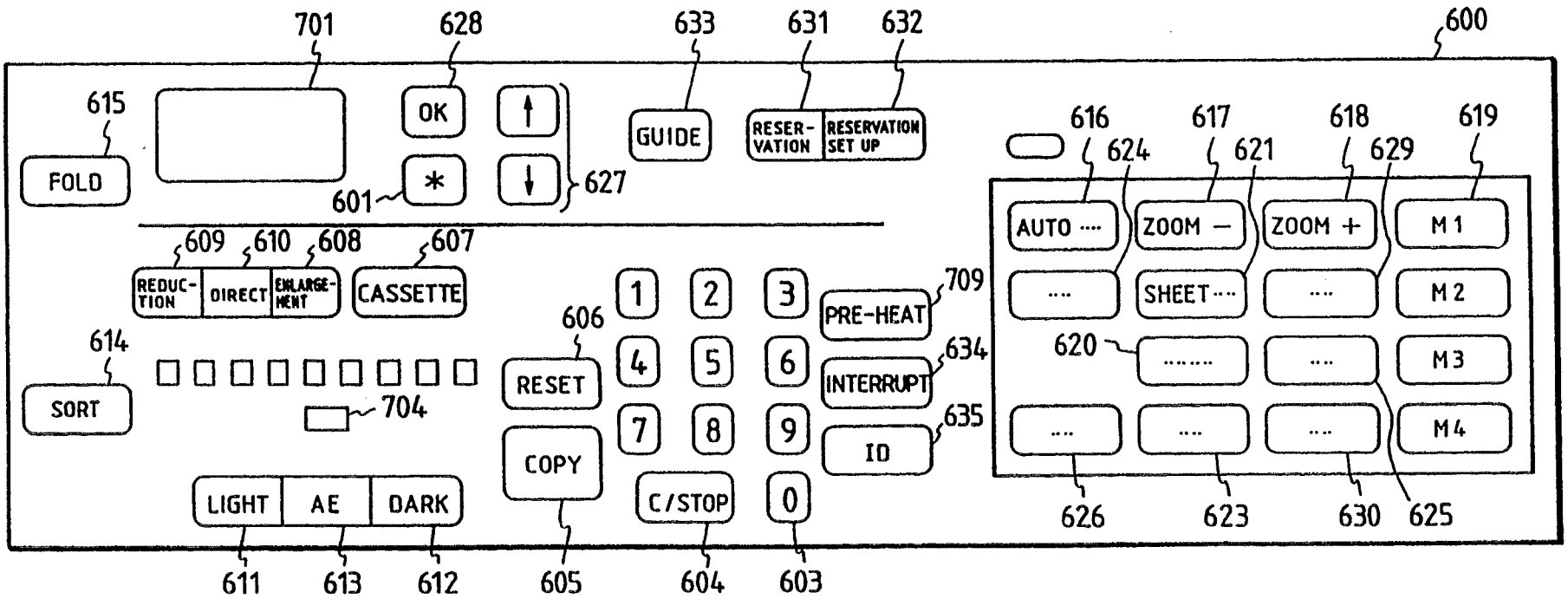
FIG. 2 is a front view showing the appearance of a manipulation panel.

FIG. 2 shows the appearance of a manipulation panel 600 arranged on the copier body 100.

Reference numeral 601 designates an asterisk (*) key used by an operator (user) in a setting mode for setting a binding margin, an original frame erasing size, and so on; 627 a cursor key used when setting items are selected in the setting mode; and 628 an OK key used for determining contents which have been set in the setting mode.

Reference numeral 606 designates an all reset key for returning to a standard mode. This all reset key 606 is also used when the standard mode is resumed from an automatic shut-off condition.

Reference numeral 605 designates a copy start key which is pressed when a copy operation is started.

Reference numeral 604 designates a clear/stop key which has a function of a clear key during a standby mode and a stop key during a copy mode. This clear/-stop key 604 is pressed for releasing a set number of copies and interrupting a continuous copy mode. The copy operation is stopped after completing a copy which is being performed upon pressing the clear/stop key 604.

Reference numeral 603 designates a set of ten-keys which are pressed for setting the number of copies. They are also used when the asterisk (*) mode is set. Reference numeral 619 designates a memory key which allows the user to register frequently used modes. In this embodiment, four kinds of modes can be registered in memories M1–M4.

Reference numerals 611 and 612 designate copy density keys which are pressed when a copy density is manually adjusted, and 603 an AE (automatic exposure adjustment) key which is pressed when a copy density is automatically adjusted in accordance with the density of originals and when an AE mode is released to manually perform a density adjustment.

Reference numeral 607 designates a sheet selecting key which is pressed when selection is made to the upper paper lifter 119, a lower paper lifter 115, a paper deck 124, or a multiple manual feeder 150. When an original is being carried on the RDF 200, an automatic paper cassette selection (APS) function can be selected by this sheet selecting key. When the APS is selected, selection is automatically made to a cassette containing sheets of paper having the same size as that of the original.

Reference numeral 610 designates an equal magnification key which is pressed when a copy in the same size is produced. Reference numeral 616 designates an automatic magnification varying key which is pressed for automatically specifying reduction or magnification of an original image in accordance with a selected size of a sheet.

Reference numeral 626 designates a dual-face key which is pressed when dual-face copies are produced from single-face originals, dual-face copies are produced from dual-face originals, or single-face copies are produced from dual-face originals; 625 a binding margin key for reserving a specified width of a binding margin on the left side of a sheet; 624 a photograph key which is pressed when a photograph is copied; and 623 a multiple copy key which is pressed when images on two different originals are copied or synthesized on the same face of a single sheet.

Reference numeral 620 designates an original frame erasing key which is used when the user erases the frame of an original in a fixed size. In this event, the size of the original is set by the asterisk key 601. Reference numeral 621 designates a sheet frame erasing key which is pressed when the frame of an original is erased in conformity to the size of a sheet of copy paper.

Reference numeral 629 designates a front cover mode setting key which is pressed when a front cover and a back cover are produced and a partition sheet is inserted. Reference numeral 630 designates a sequential page copy key which is pressed when left and right pages of an opened book are sequentially copied.

Reference numeral 614 designates a paper discharging method selecting key for selecting any one of staple sort, sort, and group discharging modes. When a staple sorter is connected to the copier body 100, the staple sort mode, sort mode or group mode is selected for copied sheets, or a selected mode is released by pressing the selecting key 614.

Reference numeral 631 designates a reservation key which is used when setting of a copy mode is started for reserved originals placed on a reservation tray 210, and when a reservation setting is released. Reference numeral 632 designates a reservation set-up key which is used as a determining key when a reservation mode is set.

Reference numeral 633 designates a guide key which is used when an explanation of a function corresponding to each key is displayed on a message display 701.

Reference numeral 701 designates the message display which is a liquid crystal display (LCD) capable of displaying copy information, including text and figures, and other communications on a screen comprised of 96×129 dots. For example, the message display 701 displays the number of copies set by the ten-keys 603, a copy magnification set by fixed form magnification varying keys 608, 609 for varying the magnification on a fixed size sheet, the equal magnification key 610 and zoom keys 617, 618, a sheet size selected by the copy sheet selecting key 607, a message indicative of a condition of the copier body 100, a guide message indicative of a manipulation procedure, and other varieties of mode setting contents.

Reference numeral 704 designates an AE indicator which is lit when AE (automatic exposure adjustment) is selected by the AE key 613; and 709 a pre-heat indicator which is lit when the copier is in a pre-heat condition.

When the RDF 200 is used in the standard mode, the copy number is set to one, and a density AE mode, automatic sheet selection, equal magnification and single-face copy from single-face originals are selected as a default setting. Determination as to whether or not the RDF 200 is used is made base on whether originals are placed on the RDF 200 or not.

Figure 3:
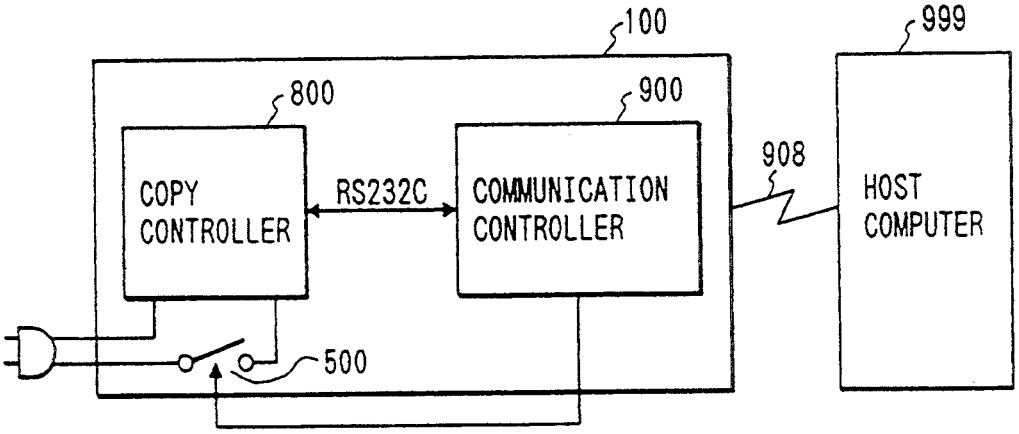
FIG. 3 is a block diagram schematically showing a control unit of the embodiment.

FIG. 3 is a block diagram showing the configuration of control units arranged in the copier 100.

Reference numeral 100 designates the copier 100; 800 a copy control unit (copy controller) for controlling a copy operation; 900 a communication control unit for communicating data via an external communication network; 908 a public network which is the external communication, and 999 a host computer system installed in an external management station for managing the copier 100. The host computer system 999 will hereinafter be referred to as "external apparatus".

Reference numeral 500 designates a switch for stopping the operation of the copier 100 which is operated when the communication control unit 900 receives from the external apparatus 999 a signal instructing the same to stop the operation of the copier 100.

Next, the copy control unit 800 and the communication control unit 900 will be described.

Figure 4:
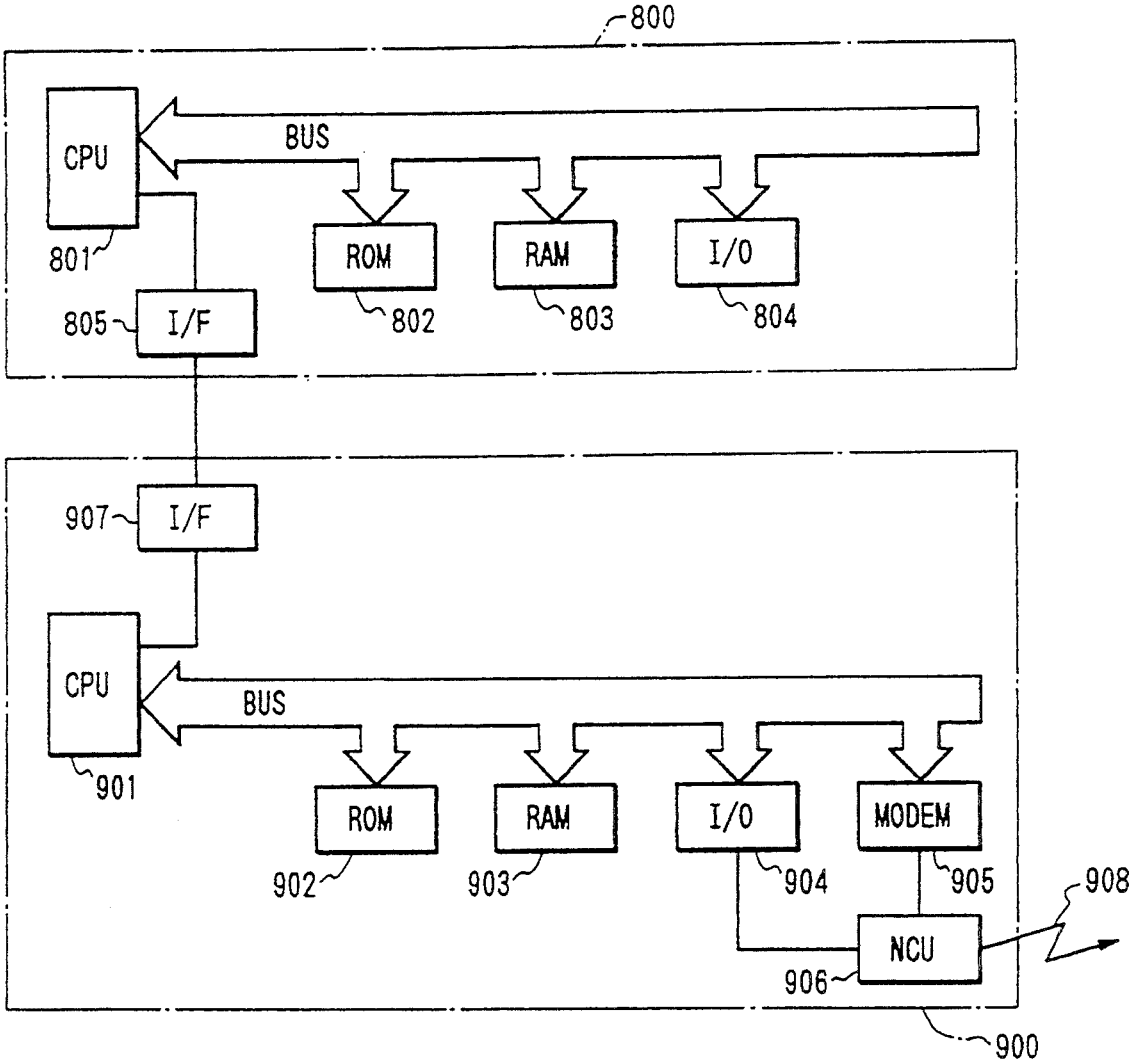
FIG. 4 is a block diagram showing a copy control unit 800 and a communication control unit 900.

FIG. 4 is a block diagram showing the structures of the copy control unit 800 and the communication control unit 900.

Reference numeral 801 designates a central processing unit (hereinafter called "CPU") for controlling the whole copier; and 802 a read only memory (hereinafter called "ROM") for storing a control procedure (control program) for the copier body 100. The CPU 801 controls respective constituent devices connected via a bus in accordance with the control procedure stored in the ROM 802.

Reference numeral 803 designates a random access memory (hereinafter called "RAM") comprising a main storage unit used to store input data, a work area and so on, for storing information such as a telephone number required to start communications with the external apparatus 999. Incidentally, the RAM 803 also stores a plurality of kinds of data to be transmitted to the external apparatus 999.

Reference numeral 804 designates an input/output IC (hereinafter called "I/O") for outputting a control signal from the CPU 801 for a load of the main motor 113 or the like, and for receiving and supplying signals from sensors or the like arranged in the fixer 122 to the CPU 801.

The communication control unit 900 for controlling communications via the external communication network 908 is controlled by the CPU 901 arranged therein. Reference numeral 902 designates a read only memory (ROM) which stores a communication control program, a connection procedure program and so on. The copy control unit 800 and the communication control unit 900 of the copier body 100 are interconnected by RS-232C interfaces 805, 907. When data is transferred from the copy control unit 800 of the copier body 100 via this RS-232C interface 907, the data to be transferred is temporarily held in RAM 903 arranged in the communication control unit 900, the CPU 901 controls a network control unit (NCU) 906 after the data transfer from the copy control unit 800 has been completed, the communication network is connected to the external apparatus 999, and then the data is transferred to the outside via a modem 905 and the NCU 906 after the connection has been established.

On the other hand, when a data transfer is performed from the external apparatus 999, the data to be transferred is temporarily held in the RAM 903 and transferred to the copy control unit 800 via the RS-232C interfaces 805, 907 in response to a request from the copy control unit 800.

The data referred to herein, comprises data and information stored in the data storing means or RAM 803 in the copier body 100. A request for data transfer may be generated on the copier side when a copy control trouble occurs, when a sheet feeding path is blocked by a sheet, or when a regular reporting time is reached, or by a control as will be later described. Such a request for data transfer is also generated by the external management side when data is collected.

The copy control unit 800 and the communication control unit 900 detect an abnormality in the copier from operation data of respective functions and data from sensors (not shown) or receive a message from the external apparatus and operate the switch 500 to turn off the power supply of the copier.

Next, description will be made as to the operation of the copier for abnormality monitoring and abnormality detection.

Figure 5:
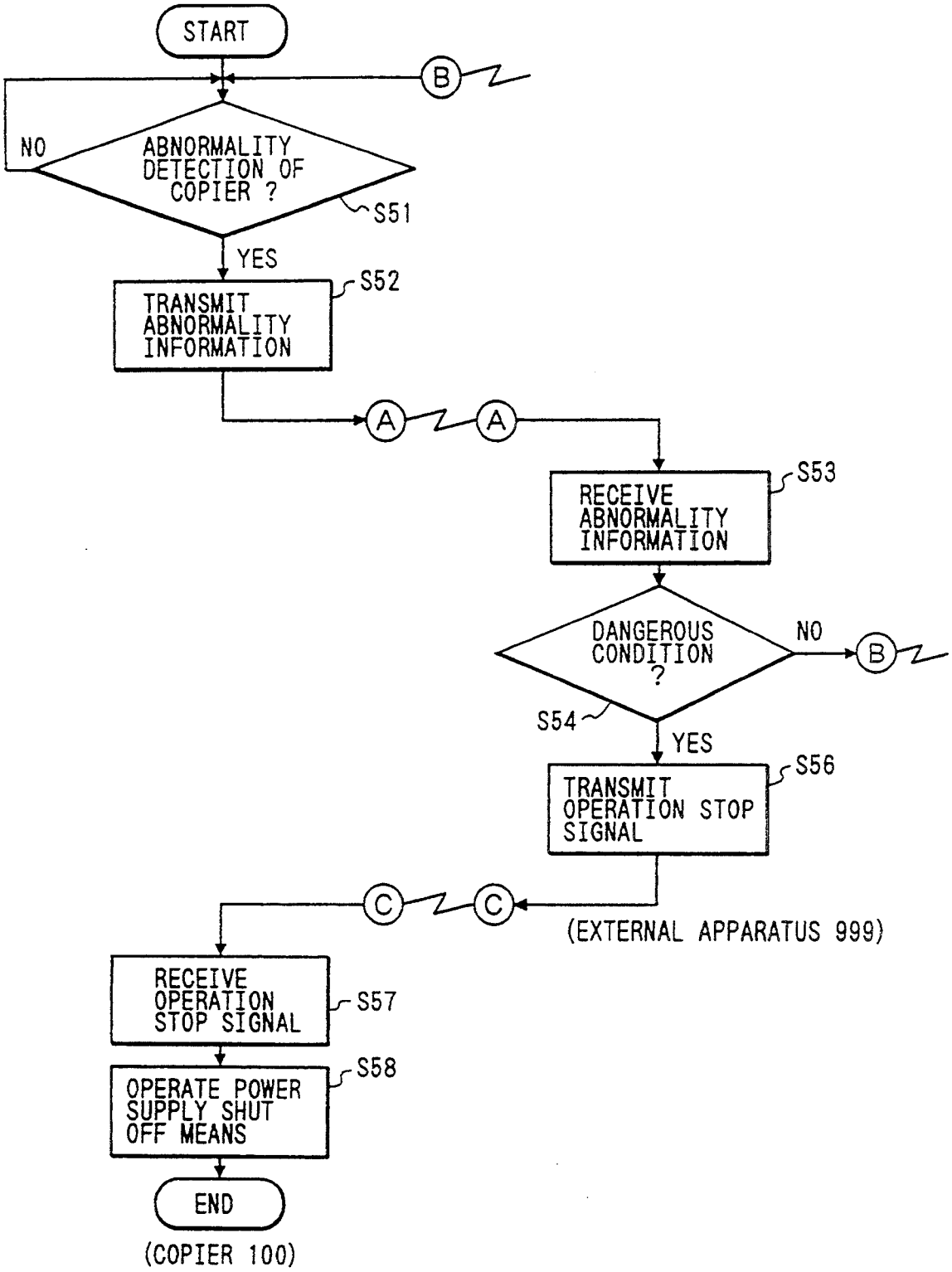
FIG. 5 is a flow chart of a control performed when an abnormality occurs in the copy control unit 800.

FIG. 5 is a flow chart of control operations performed by the copier body 100 and the external apparatus 999 according to the first embodiment. Steps S53–S56 show a control flow performed by the external apparatus 999, and the rest of steps by the copier 100.

First, an abnormality is detected in the copier 100 (step S51). If no abnormality is detected, the determination of step S51 is repeated. If an abnormality is detected, abnormality information indicating that the copier 100 is abnormal is transmitted to the external apparatus 999 via the communication network 908 (step S52). Then, when the external apparatus 999 on the management side receives the abnormality information from the copier body 100 (step S53), the copier body 100 and the external apparatus 999 determine whether or not the copier body 100 is in a dangerous condition on the basis of the contents of the abnormality information and the frequency of receiving the abnormality information (step S54). If determination is made that the copier body 100 is not in a dangerous condition, the control flow returns to step S51.

If the copier body 100 is determined to be in a dangerous condition, the external apparatus 999 transmits a signal for instructing an operation stop to the copier body 100 via the communication network (step S56). The copier body 100, upon receiving the operation stop instructing signal (step S57), operates the switch 500 of the copier body 100 to stop the operation (step S58), and then the control flow is terminated.

As described above, the copier can perform a copy operation under the control of the copy control unit and communicate, i.e., transmit and receive data via the communication network with the external apparatus which, for example, concentratively manages the copier.

While the power supply of the copier is on, abnormality detecting means keeps performing the detection. If an abnormality is detected, abnormality information is transmitted from the communication control unit to the external apparatus connected thereto, so that the copier can be always monitored by the external apparatus for managing and maintaining the copier.

Further, if the external apparatus determines that the operation of the copier must be stopped on the basis of the contents of the abnormality information, the frequency of generation of the same, and so on, a signal instructing to stop the operation is transmitted to the copier via the communication network to operate a power supply shut-off means of the copier, thereby remotely controlling the copier to operate and stop.

As described above, the present invention can provide a highly safe and reliable copier, wherein an external apparatus installed in a management section remotely monitors the copier to detect the occurrence of an abnormality at an earlier stage and stops the operation of the copier by a remote manipulation, thereby making it possible to rapidly attend to the abnormality and prevent such an abnormality from developing into a chain reaction of accidents or a serious accident.

Next, description will be made as to the operation of the copier performed when an abnormality occurs in communications.

Figure 6:
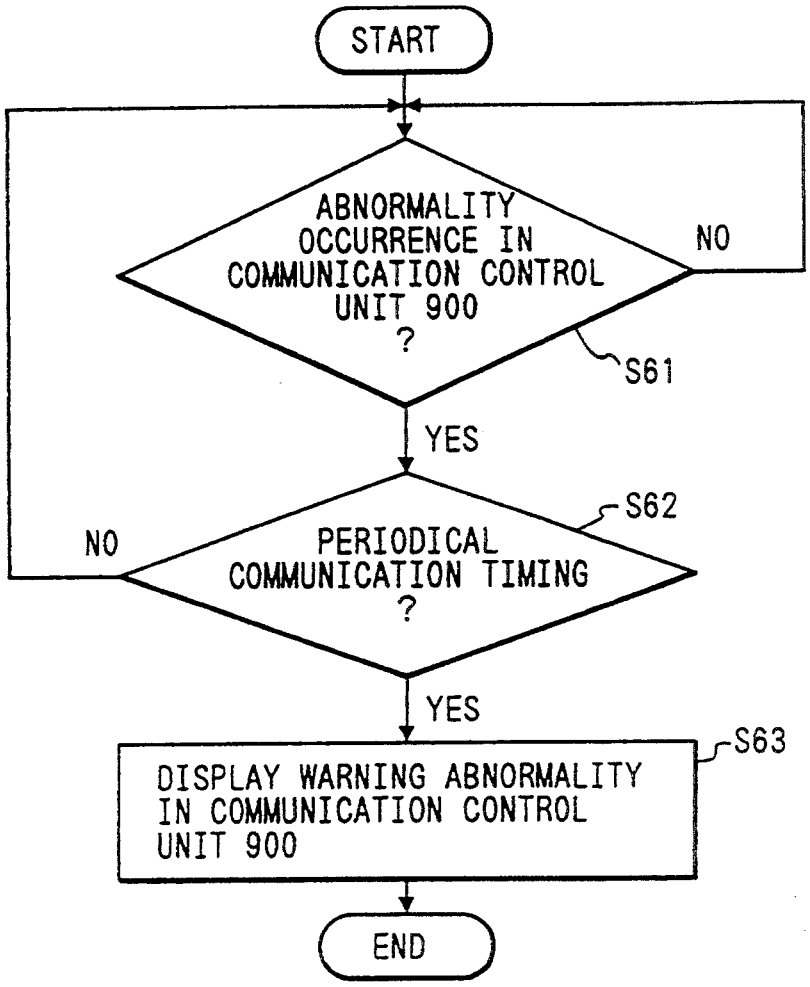
FIG. 6 through FIG. 8 are flow charts of controls performed when an abnormality occurs in the communication control unit 900.

FIG. 6 is a flow chart of a control performed when an abnormality occurs in communications. First, the CPU 801 determines whether or not a defect or an abnormality occurs in the communication control unit 900 (step S61). If no abnormality is determined, the determination at step S61 is repeated. If an abnormality is detected in the communication control unit 900 at step S61, it is determined whether or not a periodical timing of communicating with the external apparatus 999 is available (step S62). If such a timing is not available, the determination of step S61 is repeated. If the periodical communication timing is found to be available at step S62, a defective or abnormal function of the communication control unit 900 is displayed on the LCD 701.

Although a warning display may be a simple indication of the defect or abnormality of the communication control unit, a display of contents and degree of the abnormality allows service personnel to correctly and rapidly attend to the abnormality and accordingly reduce an inoperative time of the copier.

Figure 7:
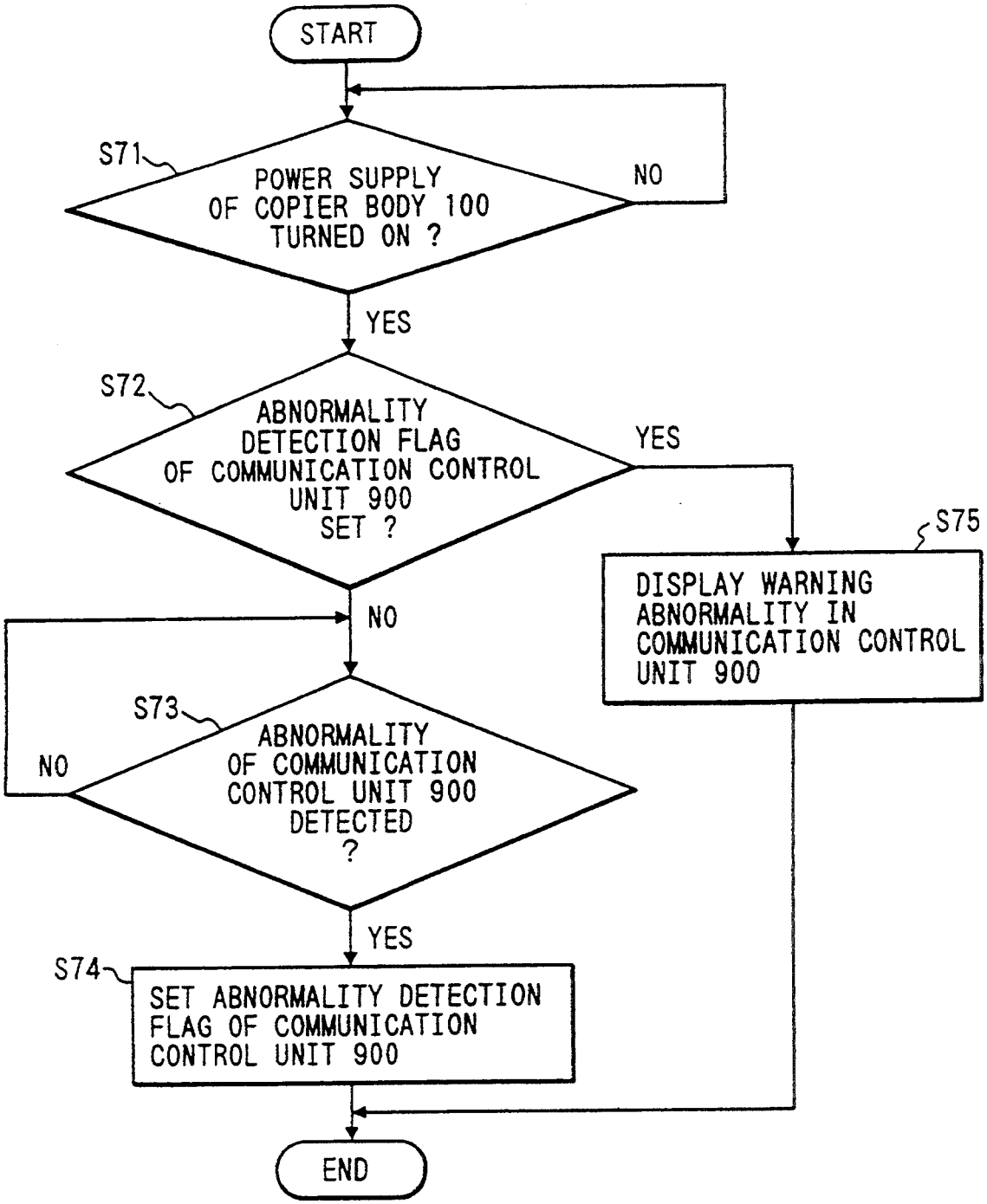

FIG. 7 is a flow chart of a control according to another embodiment, which is performed if an abnormality occurs in the communication control unit 900.

First, it is determined whether or not the power supply of the copier body 100 is on (step S71). If an off state is detected, the determination of step S71 is repeated. Contrarily, if the power supply is on at step S71, it is determined whether or not an abnormality detection flag is set (step S72). If the flag is not set, determination is made to whether or not an abnormality has been detected in the communication control unit 900 (step S73). If such an abnormality is not detected, the determination at step S73 is repeated. If an abnormality is detected at step S73, the abnormality detection flag of the communication control unit 900 is set (step S74), and the control flow is terminated.

On the other hand, if the abnormality detection flag of the communication control unit 900 has been set at step S72, a warning is displayed to indicate that the communication control unit 900 is abnormal (step S75), and then the control flow is terminated.

In this embodiment, when the power supply of the copier body 100 is turned on, a confirmation can be made whether or not the communication control unit 900 is abnormal, thereby making it possible to carry out maintenance of the control communication unit 900 at an earlier stage.

Figure 8:
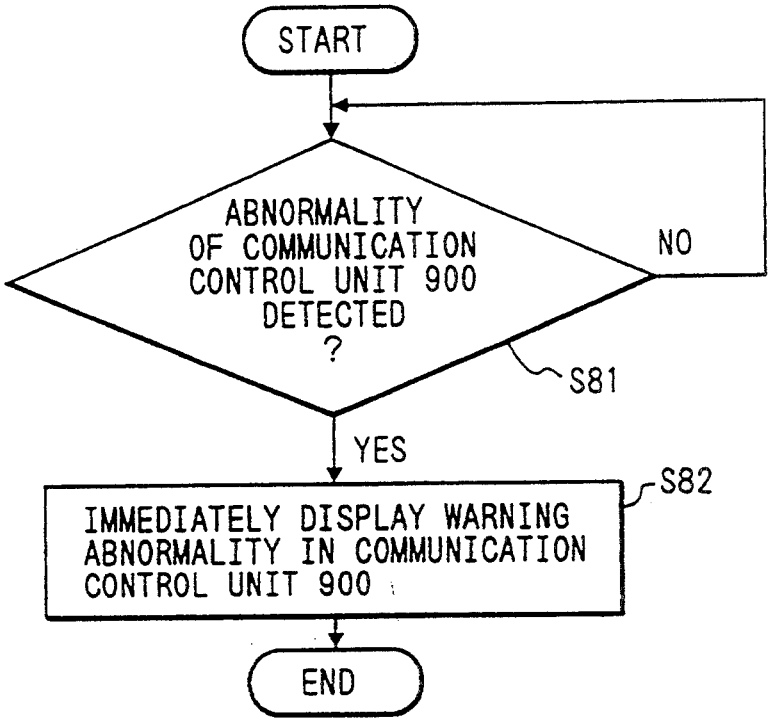

FIG. 8 is a flow chart of a control according to another embodiment, which is performed when an abnormality occurs in the communication control unit 900.

First, it is determined whether or not an abnormality is detected in the communication control unit 900 (step S83). If no abnormality is detected, step S81 is repeated. If an abnormality is detected in the communication control unit 900 at step S81, a warning is immediately displayed to indicate that the communication control unit 900 is abnormal (step S82), and then the control flow is terminated.

In this embodiment, an abnormality, when detected in the communication control unit 900, can be immediately recognized, thereby reducing an inoperative time of the copier 100.

As described above, communications such as data transmission and reception can be performed with an external apparatus via a communication network under the control of a communication control means. If a malfunction of the communication control means itself is detected, a warning is displayed on display means, thereby making it possible to rapidly and readily confirm whether the malfunction is caused by an abnormality occurring in the communication control unit 900 of the copier, an abnormal network, or an abnormality in the external apparatus, which allows service personnel to rapidly and correctly attend to an abnormality which has occurred in communications, and therefore an inoperative time of the copier can be reduced.

Figure 9:
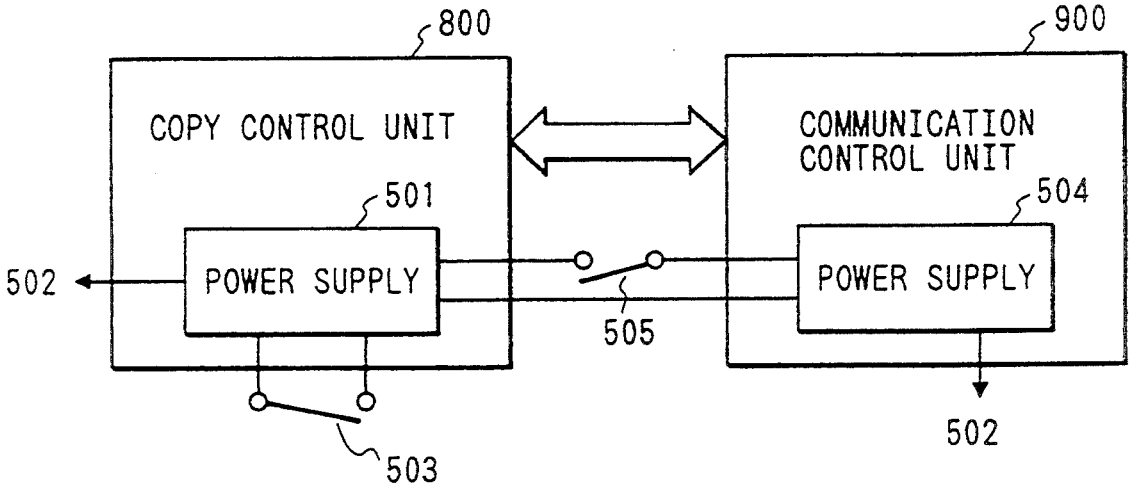
FIG. 9 is a circuit diagram showing power supplies of the copy control unit 800 and the communication control unit 900.

FIG. 9 is a diagram for explaining the relationship of power supply between the copy control unit 800 and the communication control unit 900. A power supply 501 of the copy control unit 800 is connected to an external power supply 502 and turned on and off by a switch 503. A power supply 504 of the communication control unit 900 is supplied with electric power from the copy control unit 800 via a switch 505, however, it is also connected to the external power supply 502 such that the power supply 504 can be turned on even when the copy control unit 800 is off. Incidentally, when the power supply 501 is off, the copy control unit 800 can be also supplied with electric power from the power supply 504 by turning the switch 505 on. Then, the CPU 901 detects an on or off state of the power supply 501.

Next, description will be made as to a case where a request for transmission and reception is generated while the power supply 501 of the copy control unit 800 of the copier body 100 is in off state.

Figure 10:
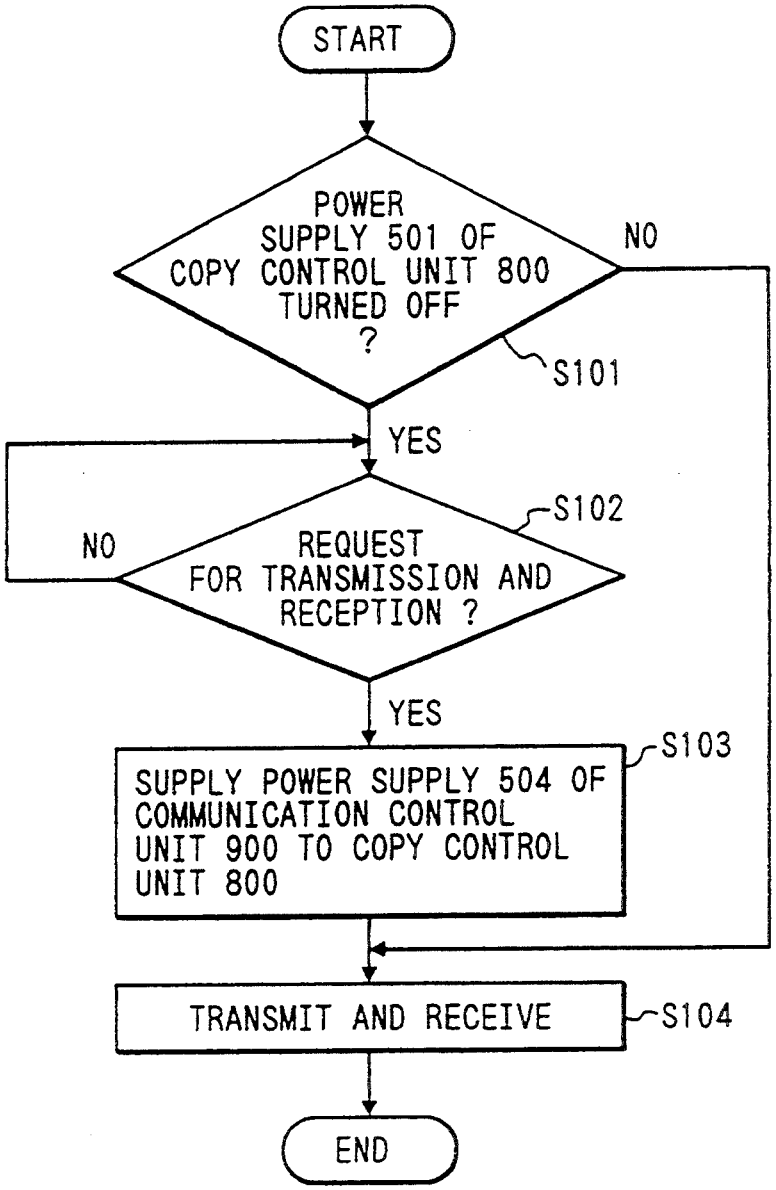
FIGS. 10 and 11 are flow charts of controls performed when the power supply of the copy control unit 800 is off.

FIG. 10 is a flow chart of a control which is performed when a request for transmission and reception is generated while the power supply of the copy control unit 800 is in off state.

First, it is determined whether or not the power supply 501 of the copy control unit 800 is turned off (step S101). If the power supply 501 is turned off, it is determined whether or not a request for transmission and reception is generated (step S102). If no such request is generated, the determination at step S102 is repeated. If the determination at step S102 indicates that the request is generated, the switch 505 is turned on to supply the copy control unit 800 with electric power from the power supply 504 of the communication control unit 900 (step S103). Thereafter, data is transmitted and received between the RAM 803 of the copy control unit 800 and the external apparatus 999 (step S104), and then the control flow is terminated.

On the other hand, if the determination at step S101 indicates that the power supply 501 is not turned off, data is transmitted and received between the RAM 803 of the copy control unit 800 and the external apparatus 999 as usual (step S104), followed by the termination of the control flow.

The above control enables data transmission and reception with the external apparatus 999 even if the power supply 501 of the copy control unit 800 has been turned off because of the termination of a copy operation or the like.

Figure 11:
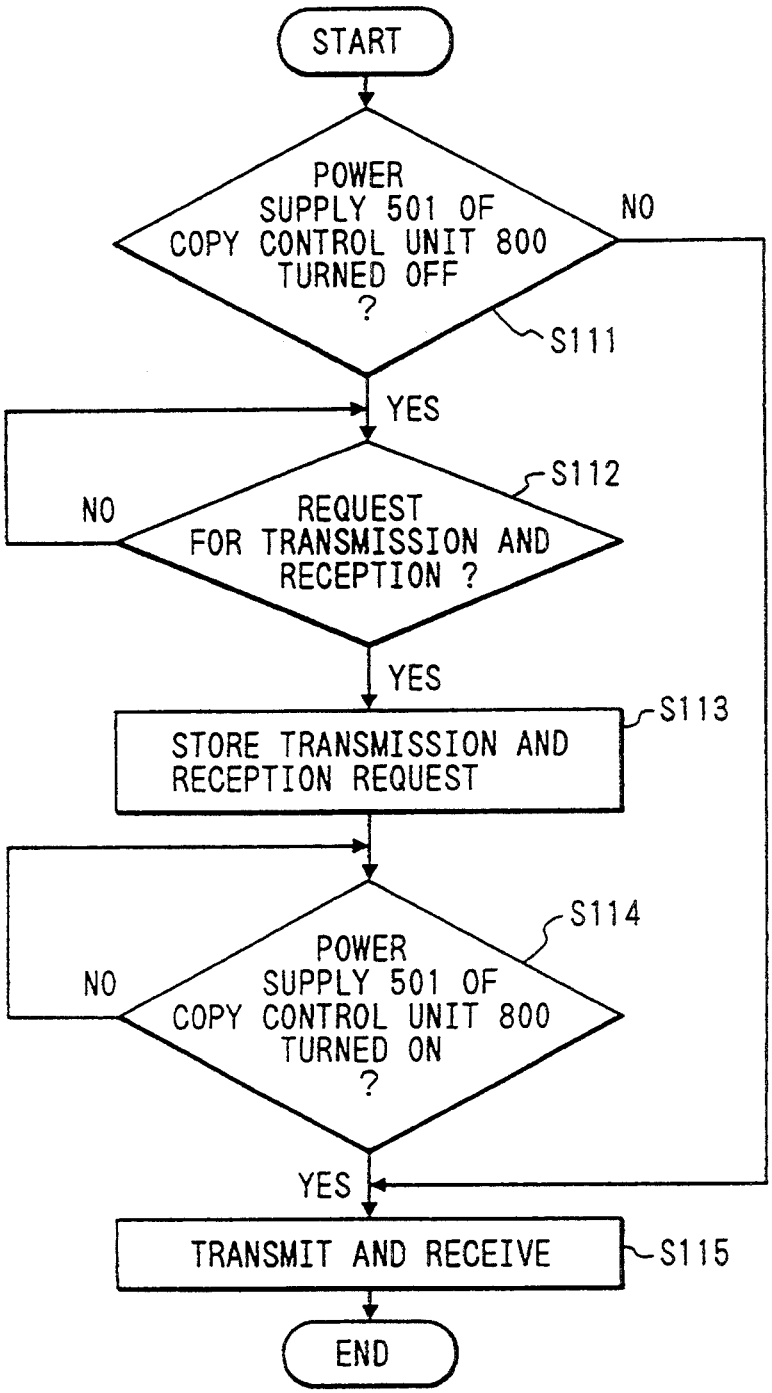

FIG. 11 is a flow chart of a control for temporarily storing a communication request when the power supply 501 of the copy control unit 800 is turned off until it is turned on.

First, it is determined whether or not the power supply 501 of the copy control unit 800 is turned off (step S111). If it is turned off, a determination is made as to whether or not a request for transmission and reception is generated (step S112). If there is no such request, the determination at step S112 is repeated. In contrast, if there is a request for transmission and reception, it is stored (step S113), and then determination is made to whether or not the power supply 501 of the copy control unit 800 is turned on (step S114). If it is not turned on, the determination at step S114 is repeated. If the determination at step S114 shows that the power supply 501 is turned on, data is transmitted and received between the external apparatus 999 and the RAM 803 based on the request stored at step S113 (step S115), and the control flow is terminated. If the determination at step S111 shows that the power supply 501 is not turned off, transmission and reception is performed with the external apparatus 999 as usual (step S115), followed by the termination of the control flow.

As described above, even when a request for transmission and reception is generated while the copier 100 is not being used, requested data transmission and reception are executed when the power supply 501 of the copy control unit 800 is turned on.

Figure 12:
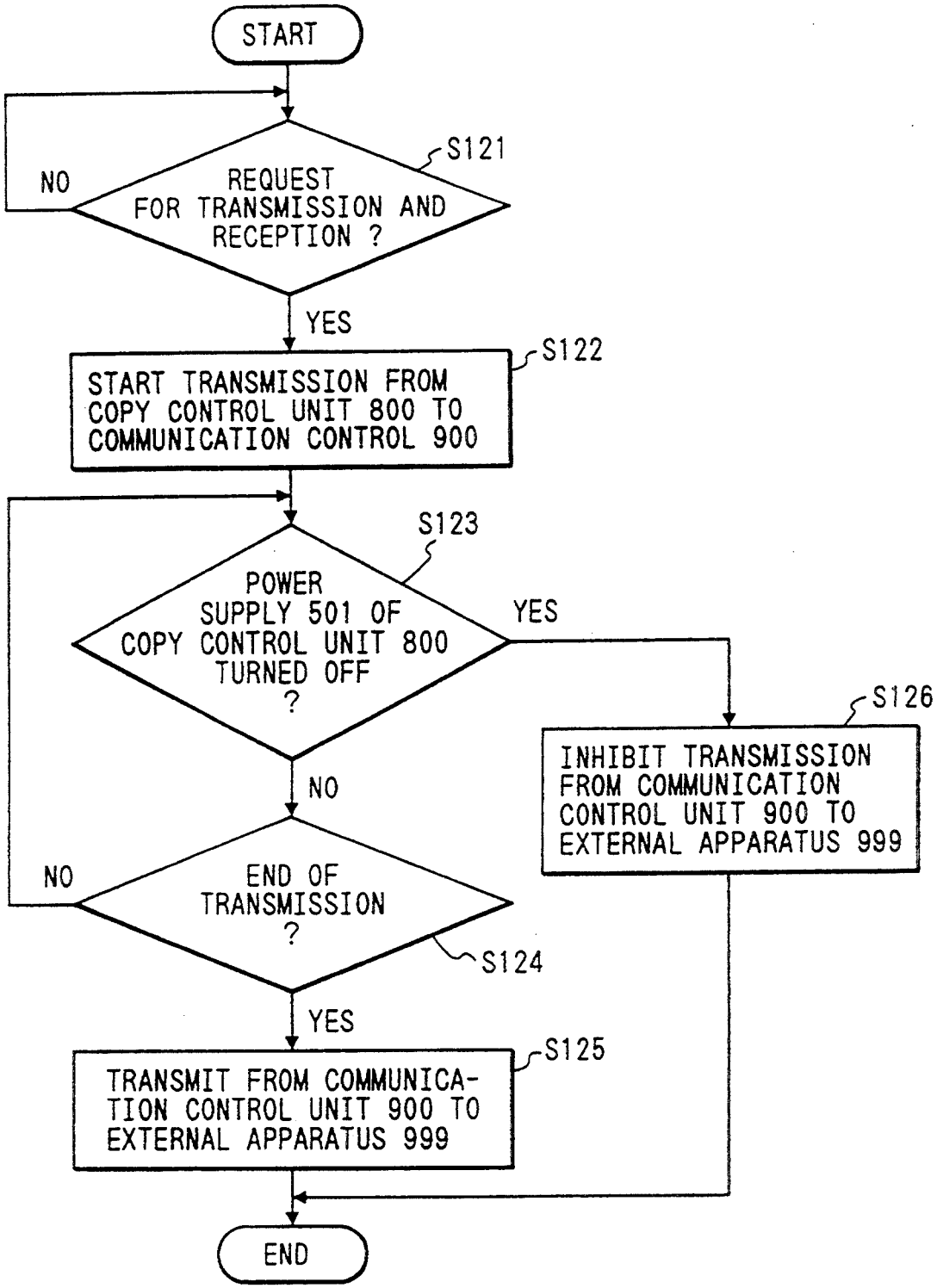
FIG. 12 is a flow chart of a control performed when the power supply of the copy control unit 800 is shut off during a communication.

FIG. 12 is a flow chart of a control which is performed when the power supply 501 of the copy control unit 800 is turned off while data is being transmitted from the copy control unit 800 to the communication control unit 900.

First, it is determined whether or not a request for transmission and reception is generated (step S121). If the answer is negative, the determination at step S121 is repeated. If the determination at step S121 shows that such a request has been generated, transmission is started from the copy control unit 800 to the communication control unit 900 (step S122). Then, it is determined whether or not the power supply 501 is turned off during the transmission (step S123). If it is not turned off, determination is made to whether or not the transmission has been terminated (step S124). If the transmission has not been terminated, the determination at step S123 is repeated. Otherwise, data is transmitted from the communication control unit 900 to the external apparatus 999 (step S125), and the control flow is terminated.

On the other hand, if the determination at step S123 shows that the power supply 501 of the copy control unit 800 is turned off during the transmission, the transmission from the communication control unit 900 to the external apparatus 999 is inhibited (step S126), and the control flow is terminated.

It is thus possible to prevent incomplete data from being transmitted to the external apparatus 999.

As described above, the copier can perform a copy operation under the control of the copy control means as well as communications such as data transmission and reception via a communication network, for example, with the external apparatus which concentratively controls the copier under the control of the communication control means.

Further, if a request for transmission and reception with the external apparatus is generated while the power supply of the copy control means is off, data damaged due to incomplete transmission and reception with the external apparatus can be prevented by a predetermined operation of the communication control means with respect to data transmission and reception performed via a communication network; for example, transmitting and receiving data with the external apparatus by a power supply provided separately from that in the copy control means or storing the generated request for transmission and reception and executing transmission and reception when the power supply of the copy control means is turned on. Also, when the power supply of the copy control means is turned off while data is being transmitted from the copy control means to the communication control means, damaged data can be likewise prevented by automatically performing an operation for inhibiting the transmission from the communication control means to the external apparatus, thereby providing the copier with a high reliability.

Next, description will be made as to a control in a structure where a copy control and a communication control are performed by a single CPU.

Figure 13:
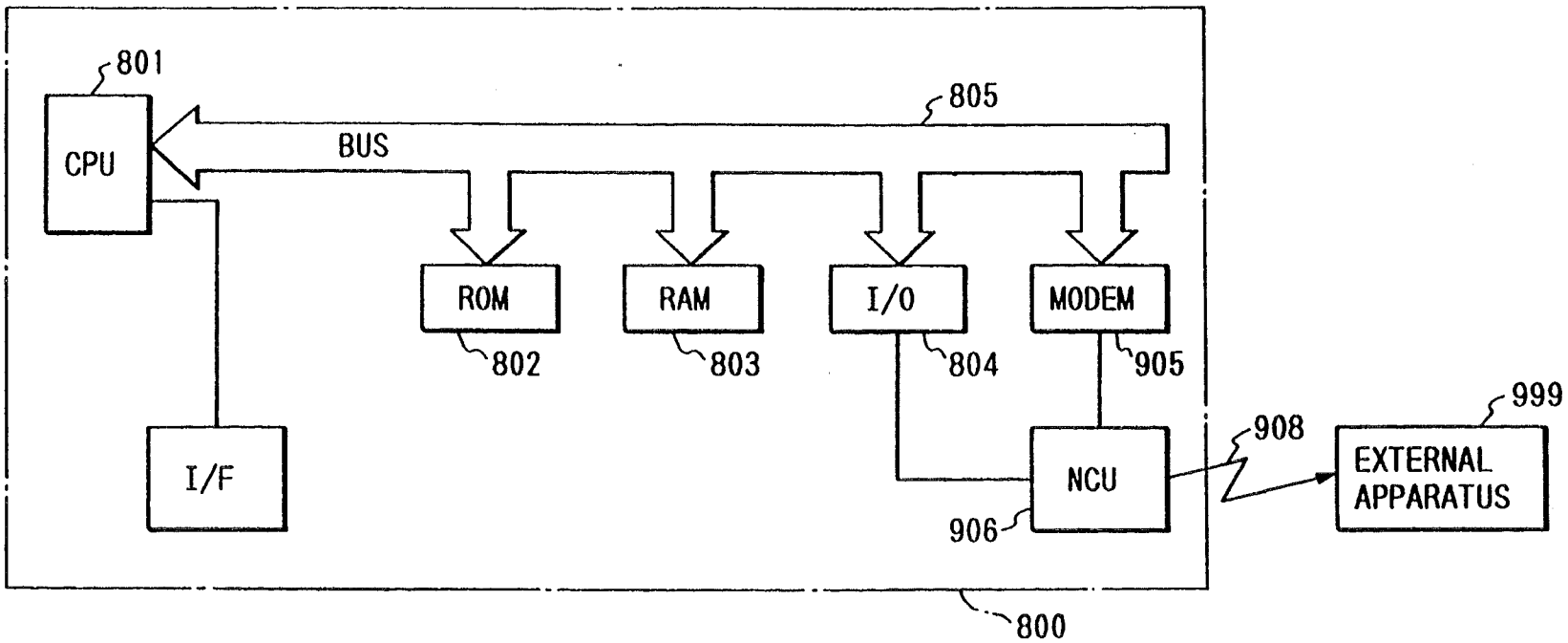
FIG. 13 is a block diagram showing the control unit 800.

FIG. 13 is a block diagram of a control unit 800 for controlling a copy operation as well as a communication operation according to this embodiment. Reference numeral 801 designates a central processing unit (hereinafter called "CPU") for controlling a copy operation and communications for transmitting and receiving data with an external apparatus 999 installed in a management section or the like via an external communication network 908; and 802 a read only memory (ROM) for storing a control program for the copy operation and a control procedure for communications. The CPU 801 controls respective constituent devices connected via a bus 805 in accordance with the control procedure stored in this ROM 802.

Reference numeral 803 designates a random access memory (RAM) used as an input data storage, a work area and so on. The RAM 803 also includes a data storing area for a communication control and also temporarily stores image formation control data which is transmitted to the external apparatus 999.

Reference numeral 804 designates an input/output IC (hereinafter called "I/O") for outputting a control signal from the CPU 801 for a load of the main motor 113 and a network control unit (NCU) 906 as well as for receiving and supplying signals from sensors arranged in the fixer or the like to the CPU 801.

When a request for data transmission is generated, the CPU 801 transfers image formation control data and so on stored in the RAM 803 via the internal bus 805, and controls the NCU 906 by the I/O 804 to transmit data to the external apparatus 999 via a modem 905, the NCU 906 and the external communication network 908.

The data referred to herein comprises data stored in the RAM 803 arranged in the copier, and a request for data transmission may be generated on the copier side when copy control trouble occurs, when a sheet feeding path is blocked by a sheet, or when a regular reporting time is reached. This request is also generated by the external, management side when data is to be collected.

Next, a description will be made as to control, performed by the structure shown in FIG. 13, for automatically transmitting data to the external apparatus installed in a management section or the like at the time of regular communications previously determined in the copier or when a particular accident or condition occurs.

Figure 14:
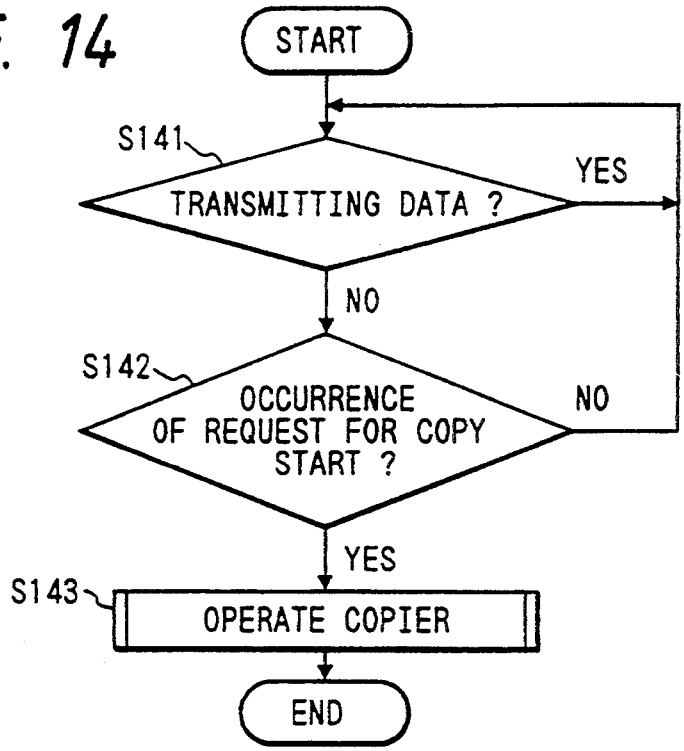
FIGS. 14 and 15 are flow charts of controls performed during a data communication.

FIG. 14 is a flow chart of a control performed by the CPU 801 for data transmission and copy operations.

When a request for data transmission is generated in the copier, or from the external apparatus via the communication network, data transmission is started. At step S141, it is determined whether or not data transmission is being executed. If the data transmission is under execution, the determination at step S141 is repeated. Otherwise, the control flow proceeds to step S142, where determination is made to whether a request for copy start exists. At this step, if the request for copy start has been generated, the control flow proceeds to step S143 to start a copy operation. If no such request exists, the control flow returns to step S141.

Thus, a copy operation can be inhibited while data is being transmitted to the external apparatus and automatically started after the completion of the data transmission.

Next, description will be made as to a control for displaying that a copy operation is being inhibited in the above-mentioned condition.

Figure 15:
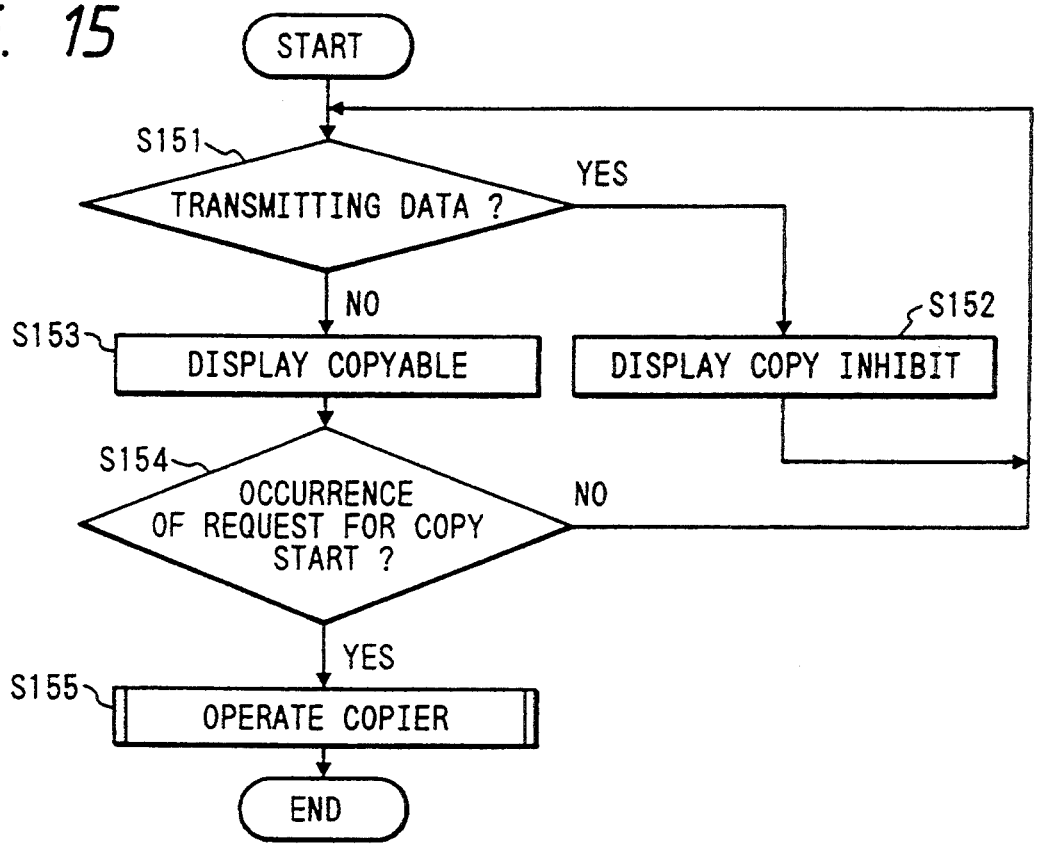

FIG. 15 is a flow chart of a control performed by the CPU 801.

At step S151, if data transmission is in progress, the control flow proceeds to step S152, where a message indicative of copy inhibition, for example, "COPY INHIBITED DUE TO DATA TRANSFER IN PROGRESS" on the LCD 701 which is a display panel of the copier, and then returns to step S151.

If data is not being transmitted at step S151, step S153 is entered, where a message indicative of a copy available condition is displayed on the display panel or LCD 701. Then, step S154 is entered, where determination is made to whether or not a request for copy start exists. If a request for copy start has been generated, step S155 is entered to start a copy operation. Otherwise, the control flow returns from step S154 to step S151.

As described above, a display of a copy inhibited condition during data transmission can inform the user of such a condition. It is therefore possible to eliminate an excessive time required for data transmission and long-duration arbitration of the communication network due to parallel execution of a data transmission and a copy operation. Further, by displaying a copy inhibited condition to the user, the user will be prevented from taking the copy inhibited condition for a copy disabled condition due to copier trouble itself.

As described above, the copier performs a copy operation under the control of an image formation operation by the control means. Meanwhile, image formation control data is transferred by an internal bus to be transmitted and received with the external apparatus via a communication network.

During transmission of the control data, the control means inhibits an image formation even if a request for image formation is generated, whereby the control means achieves control data transmission without the necessity of simultaneously processing a transmission control and a copy operation control.

With the above control, a copier can be provided which is free from problems such as an increase in time necessary to data transmission, long-duration arbitration of an external network which may hinder other communications, and an excessively network rental fee charge.

Incidentally, the present invention is not limited to an implementation in a copier and can be extensively applied to image forming apparatus arranged in a facsimile, a printer, an electronic file and so on. Also, communications between the copier and the external apparatus may be radio communications or optical communications except for the network communications described in the foregoing embodiments.

What is claimed is:

1. An apparatus for monitoring an image forming apparatus, said monitoring apparatus comprising:

input means for receiving data from the image forming apparatus, the data being indicative of a condition of the image forming apparatus;

storage means for storing the received data;

communication means for communicating between said storage means and an external apparatus installed at a position separate from the image forming apparatus; and control means for inhibiting said communication means from transmitting the data stored in said storage means when a power supply for supplying the image forming apparatus with electric power is turned off while the data is being received by said input means.

2. An apparatus for monitoring an image forming apparatus according to claim 1, wherein the data is data relating to an abnormality of the image forming apparatus.

3. An apparatus for monitoring an image forming apparatus, said monitoring apparatus comprising:

input means for receiving data from an image forming apparatus, the data being indicative of a condition of the image forming apparatus;

detecting means for detecting whether the image forming apparatus is being supplied with electric power;

storage means for storing the received data;

communication means for communicating between said storage means and an external apparatus installed at a position separate from the image forming apparatus; and control means for inhibiting said communication means from transmitting the data stored in said storage means when said detecting means detects that a power supply for supplying the image forming apparatus with electric power is turned off while the data is being received by said input means.

4. An apparatus for monitoring an image forming apparatus according to claim 3, wherein the data is data relating to an abnormality of the image forming apparatus.

5. A method of monitoring an image forming apparatus comprising the steps of:

receiving data from the image forming apparatus, the data being indicative of a condition of the image forming apparatus;

storing the received data;

transmitting the stored data to an external apparatus installed at a position separate from the image forming apparatus; and inhibiting transmission of the stored data when a power supply for supplying the image forming apparatus with electric power is turned off while the data is being received from the image forming apparatus.

6. A method according to claim 5, wherein the data is data relating to an abnormality of the image forming apparatus.

7. A method of monitoring an image forming apparatus comprising the steps of:

receiving data from the image forming apparatus, the data being indicative of a condition of the image forming apparatus;

storing the received data;

transmitting the stored data to an external apparatus installed at a position separate from the image forming apparatus;

detecting whether the image forming apparatus is being supplied with electric power; and inhibiting transmission of the stored data when said detecting step detects that a power supply for supplying the image forming apparatus with electric power is turned off while the data is being received from the image forming apparatus.

8. A method according to claim 7, wherein the data is data relating to an abnormality of the image forming apparatus.

* * * * *

UNITED STATES PATENT AND TRADEMARK OFFICE

CERTIFICATE OF CORRECTION

PATENT NO. : 5,420,667

DATED : May 30, 1995

INVENTOR(S) : Kaneko et al.

It is certified that error appears in the above-indentified patent and that said Letters Patent is hereby corrected as shown below:

SHEET 12 OF THE DRAWINGS:

In Fig. 15, "COPYABLE" should read --COPIABLE--.

COLUMN 2:

Line 25, "number" should read --number,--.

COLUMN 4:

Line 60, "to" should read --to be--.

COLUMN 6:

Line 56, "base" should read --based--.

COLUMN 9:

Line 12, "municating" should read --munication--.

UNITED STATES PATENT AND TRADEMARK OFFICE

CERTIFICATE OF CORRECTION

PATENT NO. : 5,420,667

DATED : May 30, 1995

INVENTOR(S) : Kaneko et al.

It is certified that error appears in the above-indentified patent and that said Letters Patent is hereby corrected as shown below:

COLUMN 13:

Line 55, "excessively" should read --excessive--.

Signed and Sealed this

Twenty-sixth Day of September, 1995

Bruce Lehman

*Attest:*

BRUCE LEHMAN

*Attesting Officer*

*Commissioner of Patents and Trademarks*